United States Patent [19]

Galtz et al.

[11] 4,447,187

[45] May 8, 1984

[54] LATERAL-DUCT FAN

[75] Inventors: Rüdiger Galtz, Munich; Rudolf Reinhardt, Krailling, both of Fed. Rep. of Germany

[73] Assignee: Webasto-Werk W. Baier GmbH & Co., Gauting, Fed. Rep. of Germany

[21] Appl. No.: 454,025

[22] Filed: Dec. 28, 1982

[30] Foreign Application Priority Data

Feb. 2, 1982 [DE] Fed. Rep. of Germany ..... 3203325

[51] Int. Cl.[3] ..... F04D 29/34

[52] U.S. Cl. ..... 415/53 R; 415/213 T; 415/170 A; 415/53 T

[58] Field of Search ..... 415/53 R, 53 T, 213 T, 415/52, 54, 55, 56, 145, 170 B, 98, 86, 87, 96, 99, 170 A

[56] References Cited

U.S. PATENT DOCUMENTS 3,871,797 3/1975 Igarashi ..... 415/213 T
4,152,096 5/1979 Murakami ..... 415/170 A
4,231,718 11/1980 Ruhl ..... 415/53 T

FOREIGN PATENT DOCUMENTS 1016885 10/1957 Fed. Rep. of Germany ..... 415/53

*Primary Examiner*—Stephen Marcus
*Assistant Examiner*—Kwon John
*Attorney, Agent, or Firm*—Antonelli, Terry & Wands

[57] ABSTRACT

A lateral-duct fan having a lateral duct approximately of the shape of a torus cut normally to its axis of symmetry, and having a coaxial impeller having axially-symmetrically lined-up blades at its front side in a ring-shaped recess that faces essentially opposite the lateral duct with an axial gap therebetween. In order to reduce the critical interdependence between the size of the axial gap and the output of the fan, and thus increase the tolerances during the adjustment of the axial gap, i.e., to improve the output values of the fan with the same axial gap, it is provided that the radius of at least one edge of the recess, measured at the front side of the impeller, is smaller than the radius of a closest edge of the lateral duct, measured at an inner surface of a housing in which the lateral duct is formed.

16 Claims, 3 Drawing Figures

LATERAL-DUCT FAN

BACKGROUND AND SUMMARY OF THE INVENTION

The invention relates to a lateral-duct fan having a lateral duct approximately of the shape of a torus cut normally to its axis of symmetry, and having a coaxial impeller having axially-symmetrically lined-up blades, at its front side, in a ring-shaped recess that essentially faces the lateral duct with a gap located axially therebetween.

A lateral-duct fan of this type is known from the Published German Patent Application No. 21 35 093. Lateral-duct fans or ring-duct fans of this type furnish high pressures, with relatively low efficiency. Their characteristic curves are steep. The output data depend considerably on the adjustment of the axial gap and change in a critical manner with a change of the axial gap.

The present invention, therefore, has for an object the creating of a lateral-duct fan of the initially mentioned type, where the sensitivity of the interdependence between the axial gap and the output is reduced and, with the same axial gaps, the fan output is increased.

This object is achieved, in accordance with a preferred embodiment of the present invention, by the fact that the radius of at least one edge of the ring-shaped recess, measured at a boundary surface between the lateral duct and the impeller, is smaller than the radius of the closest edge of the lateral duct. In this manner, an increase in efficiency (with the same width of the axial gap) and a considerably smaller interdependence between the width of the axial gap and the fan efficiency is surprisingly achieved. The measures taken in accordance with the present invention are based on the following realization: In the case of lateral-duct fans, a helix-shaped secondary flow superimposes itself on the main flow (which travels in a circumferential direction) in such a way that gas from the ring-duct, in the area close to the axis, is drawn into the chambers between the blades of the impeller and is blown out again in the area away from the axis into the ring duct. If, as is usually the case in the known lateral-duct fans, the inside and outside edges of the impeller chambers, i.e., of the ring-shaped recess receiving the blades, are in alignment with the inside and outside edges of the lateral duct, gas coming out of the impeller chamber, because of the existing axial gap, on the outside, rushes against the outside boundary edge of the lateral duct, while vice-versa, in the area close to the axis, the secondary flow leaving the ring duct, rushes against the inside circumferential edge of the impeller chambers. The result is a damming effect which, in an undesirable manner, increases the ineffectiveness of the sealing gap.

Because, according to the present invention, at least one circumferential edge of the impeller chamber is located, by one diametral jump (i.e., a distance corresponding to the difference between the radii of the respective edges) radially within one circumferential edge of the housing ring duct, the damming of gas in the transition area of the secondary flow from the impeller chambers in the housing ring duct and vice-versa are avoided, and the ineffectiveness of the sealing gap is decreased. Because of a reduction of the dynamic pressure achieved by means of the invention, the sensitivity in regard to the interdependence between the axial gap width and the fan output is also reduced.

According to an especially advantageous development of the invention, a diametral jump is not only provided in the area of one edge, but both edges, i.e., at the outside circumferential edge as well as at the inside circumferential edge. The above-described advantageous effect is thus increased even more.

Particularly good results are obtained if, according to a preferred embodiment, the diametral jump at the inside edge and/or the outside edge amounts to 1 to 5 times the dimension of the axial gap.

According to another advantageous aspect of the invention, the lateral duct is constructed in the bottom of an approximately can-shaped housing, in which case the impeller has a cylindrical shape and is disposed in the can-shaped housing in a manner leaving a radial sealing gap. The radial sealing gap should be as narrow and long as possible. By means of this sealing gap, the ineffectiveness or gap less of the axial sealing gap is reduced in the circumferential direction, because the radial gap may partly take over the sealing function of the axial gap and thus increase it. Another increase of the sealing effect and of the rise of the output of the fan can be obtained, according to another advantageous aspect of the invention, by the fact that, in the bottom of the can-shaped housing, a central cylindrical recess is provided into which a corresponding pin projects, that is shaped onto the impeller, while leaving a cylindrical ring gap therebetween. This cylindrical ring gap also promotes the sealing function of the axial gap, as explained above.

The front surface of the impeller, that faces away from the ring or lateral duct, may also be used to further increase the sealing effect, if, according to another advantageous feature, the can-shaped housing is closed by a lid connected with its cylinder jacket, while leaving an axial sealing gap, in the direction of the impeller, in which lid a recess for a drive shaft of the impeller is provided.

Another increase of the sealing effect, according to an advantageous further development of the invention, can be achieved by the fact that the impeller, at its rear surface facing away from the lateral duct, has ribs in the manner of a radial fan, which are located between the impeller and the lid and which, at the back side of the impeller, build up a pressure which counteracts the flow through the cylindrical sealing gap between the can-shaped housing and the impeller.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
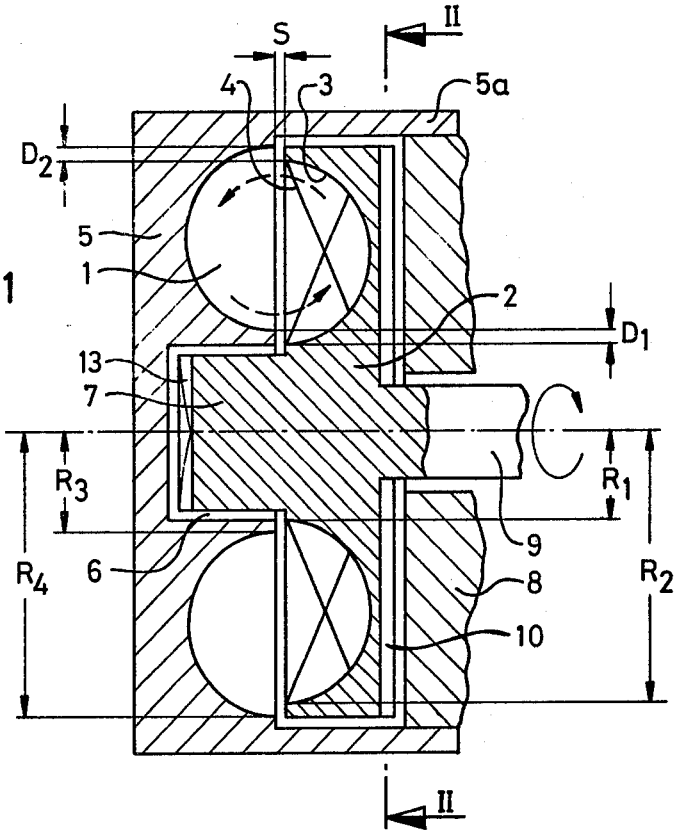
FIG. 1 shows a longitudinal section through a lateral-duct fan according to the invention.

The lateral-duct fan shown in longitudinal section in FIG. 1 has a can-shaped housing 5 with cylindrical walls 5*a*. A lateral duct 1 is constructed in the bottom of the can-shaped housing which has the shape of an annular tee-slot or of a torus cut normally to its axis of symmetry. An essentially cylinder-shaped impeller 2 is disposed in the can-shaped housing and is drivable by a shaft 9. On its front side, facing the lateral duct 1, the impeller has a ring-shaped recess 3, which, in regard to shape and position, corresponds to approximately the shape of the lateral duct 1. Blades 4 are arranged axially-symmetrically in ring-shaped recess 3. The inlet and outlet openings leading into the lateral duct 1 as well as the bars for the separation of the inlet and outlet opening are part of the state of the art and are not shown for reasons of simplicity, and reference can be made to our co-pending U.S. application Ser. No. 447,186 filed Dec. 6, 1982, which corresponds to our German Application No. P 32 09 904.5, for example.

Figure 2:
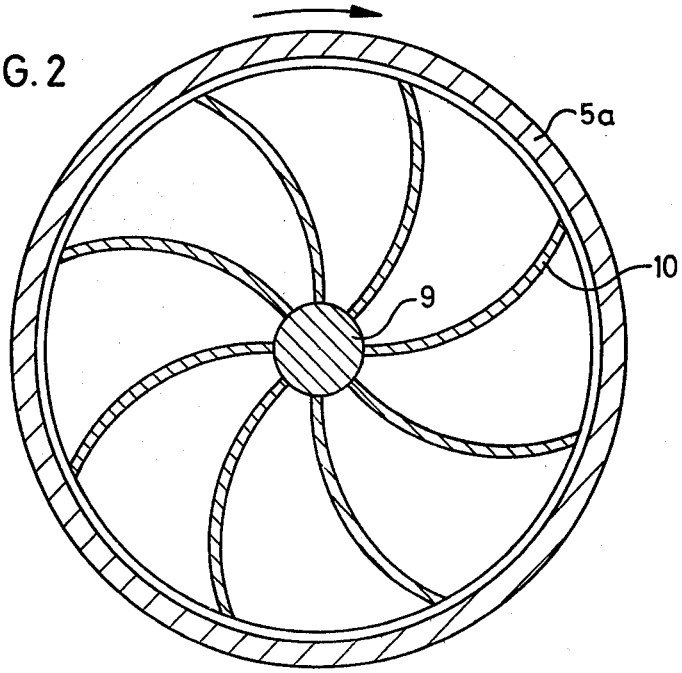
FIG. 2 shows a view along cut II—II in FIG. 1.

A central pin 7 is shaped onto the front side of the impeller 2 facing the lateral duct 1, with said pin 7 projecting into a corresponding recess 6 in the bottom of the can-shaped housing 5. Because of the cylindrical arrangement of the impeller and of the can-shaped housing, radial sealing gaps are created between the outside shell of the impeller 2 and the cylindrical jacket 5*a* of the can-shaped housing 5 as well as between the outside jacket of the pin 7 and the cylindrical wall of the recess 6. These sealing gaps should be as narrow and long as possible. At the rear surface of the impeller 2, facing away from the lateral duct 1, blades or ribs 10 are provided in the manner of a radial fan. The blades 10 at the rear side of the impeller 2, facing away from the lateral duct 1, are shown especially clearly in FIG. 2. The can-shaped housing 5 is closed by a lid 8 having an opening for the drive shaft 9 of the impeller 2.

According to the preferred embodiment of the invention, the recess 3, containing the blades 4, in the impeller is somewhat displaced radially toward the inside (i.e., toward the rotational axis of the impeller) so that, at the transition point between the lateral duct and the recess containing the blades, in the transition area close to the axis as well as away from the axis, a step or diametral jump is created. Preferably, the difference $D_1$ between the radius $R_1$ of the inside edge of the recess containing the blades and the radius $R_3$ of the inside edge of the lateral duct is approximately twice the size of the gap S in the axial direction, between the bottom of the housing 5 and the body of the impeller 2. The same is true at the outside edges or outer margins for the difference $D_2$ between the radii $R_2$ and $R_4$.

Figure 3:
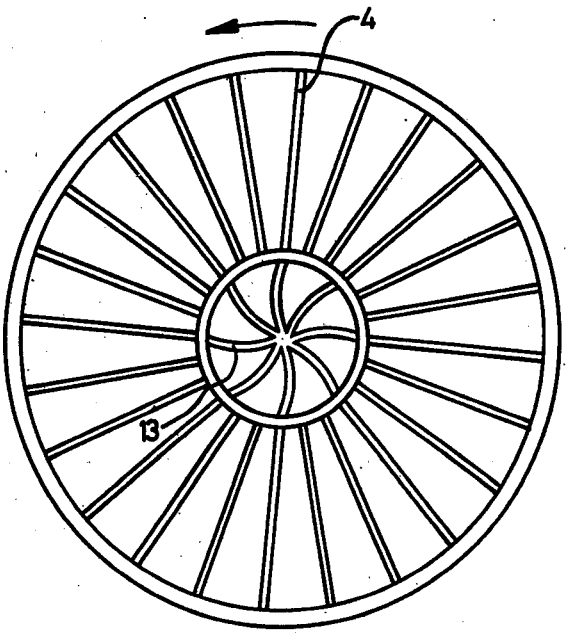
FIG. 3 shows a view of the impeller from the direction at the left side in FIG. 1.

The lateral-duct fan operates as follows: The impeller 2 is rotated by means of the shaft 9, whereby the gas contained in the lateral duct 1 is set into motion and is conveyed by means of suitable bars as well as inlet and outlet mechanisms. A helical secondary flow is superimposed on the main flow of the gas traveling in the circumferential direction. This secondary flow is indicated by interrupted arrows in FIG. 1. The gas from the lateral duct 1, in the area close to the axis, is drawn into the chambers between the blades of the impeller and in the area that is away from the axis and is blown back into the lateral duct. Since the impeller does not connect without a gap at the surface containing the lateral duct, and a sealing gap S is provided between the two, a dynamic pressure is created in the case of the lateral-duct fans, according to the state of the art, in the transition areas between the lateral duct and the impeller recess, with said dynamic pressure increasing the ineffectiveness of the sealing gap in an undesired manner. By the fact that, according to the invention, the edges of the recess 3, containing the impeller blades 4, are located slightly closer to the rotational axis, i.e., thus have a smaller radius than the corresponding edges of the lateral duct 1, the helical secondary flow can, in an unimpaired fashion, travel, from the direction of the lateral duct, back into recess 3 without creating a damming effect at the edge and without the connected disadvantages. By means of the blades 10 on the side of the impeller facing away from ring duct 1, a counterpressure to the pressure generated by the ring-duct fan is maintained in the radial sealing gap between the walls 5*a* of the can-shaped housing 5 and the cylinder wall of the impeller 2, whereby the ineffectiveness of the radial sealing gap is reduced. A corresponding function is carried out by blades or ribs 13 on the front side of the impeller on the end of the pin 7, which are also arranged in the manner of a radial fan (FIG. 3).

While we have shown and described a single embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A lateral-duct fan having a housing with a lateral duct, of approximately the shape of a torus cut normally to its axis of symmetry, in an inner boundary surface thereof, and having an impeller with axially-symmetrically lined-up blades in a ring-shaped recess within a boundary surface on a front side thereof, said impeller being arranged coaxially with respect to said lateral duct with its recess disposed facing essentially opposite the lateral duct and with an axial gap between said boundary surfaces, wherein the radii of inner and outer edges of the ring-shaped recess, measured at the boundary surface of the impeller, are smaller than the inner and outer radii of the respective closest edge of the lateral duct, measured at the boundary surface of the housing.

2. A lateral-duct fan according to claim 1, wherein the differences between the respective radii are from 1 to 5 times the distance of the axial gap between said boundary surfaces.

3. A lateral-duct fan according to claim 2, wherein the housing is can-shaped and the lateral duct is constructed in the bottom thereof, and wherein the impeller has a cylindrical shape and is disposed in the can-shaped housing so as to provide a radial sealing gap therebetween.

4. A lateral-duct fan according to claim 1, wherein the housing is can-shaped and the lateral duct is constructed in the bottom thereof, and wherein the impeller has a cylindrical shape and is disposed in the can-shaped housing so as to provide a radial sealing gap therebetween.

5. A lateral-duct fan according to claim 3, wherein a pin is formed on said impeller and a central cylindrical recess is provided in the bottom of the can-shaped housing into which said pin projects, said pin being sized relative to said cylindrical recess so as to provide a radial ring gap therebetween.

6. A lateral-duct fan according to claim 4, wherein a pin is formed on said impeller and a central cylindrical recess is provided in the bottom of the can-shaped housing into which said pin projects, said pin being sized relative to said cylindrical recess so as to provide a radial ring gap therebetween.

7. A lateral-duct fan according to claim 6, wherein the can-shaped housing is closed by a lid connected with a cylinder jacket of the housing at a distance from a rear side of the impeller providing an axial sealing gap between the lid and impeller, and wherein a recess for a drive shaft is provided in said lid.

8. A lateral-duct fan according to claim 4, wherein the can-shaped housing is closed by a lid connected with a cylinder jacket of the housing at a distance from a rear side of the impeller providing an axial sealing gap between the lid and impeller, and wherein a recess for a drive shaft is provided in said lid.

9. A lateral-duct fan according to claim 5, wherein the can-shaped housing is closed by a lid connected with a cylinder jacket of the housing at a distance from a rear side of the impeller providing an axial sealing gap between the lid and impeller, and wherein a recess for a drive shaft is provided in said lid.

10. A lateral-duct fan according to claim 9, wherein the impeller, at its rear side, facing away from the lateral duct, has radial fan-type ribs.

11. A lateral-duct fan according to claim 7, wherein the impeller, at its rear side, facing away from the lateral duct, has radial fan-type ribs.

12. A lateral-duct fan according to claim 8, wherein the impeller, at its rear side, facing away from the lateral duct, has radial fan-type ribs.

13. A lateral-duct fan according to claim 9, wherein the pin has radial fan-type ribs on a front end thereof.

14. A lateral-duct fan according to claim 5, wherein the pin has radial fan-type ribs on a front end thereof.

15. A lateral-duct fan according to claim 14, wherein the pin has radial fan-type ribs on a front end thereof.

16. A lateral-duct fan having a housing with a lateral duct, of approximately the shape of a torus cut normally to its axis of symmetry, in an inner boundary surface thereof, and having an impeller with axially-symmetrically lined-up blades in a ring-shaped recess within a boundary surface on a front side thereof, said impeller being arranged coaxially with respect to said lateral duct with its recess disposed facing essentially opposite the lateral duct and with an axial gap between said boundary surface, wherein the radius of at least one edge of the ring-shaped recess, measured at the boundary surface of the impeller, is smaller than a respective radius, measured at the boundary surface of the housing, of a closest edge of the lateral duct; wherein the housing is can-shaped and the lateral duct is constructed in the bottom thereof; wherein the impeller has a cylindrical shape and is disposed in the can-shaped housing so as to provide a radial sealing gap therebetween; wherein a pin is formed on said impeller and a central cylindrical recess is provided in the bottom of the can-shaped housing into which said pin projects, said pin being sized relative to said cylindrical recess so as to provide a radial ring gap therebetween; and wherein the pin has radial fan-type ribs on a front end thereof.

* * * * *